US011264782B2

(12) United States Patent
Wang et al.

(10) Patent No.: US 11,264,782 B2
(45) Date of Patent: Mar. 1, 2022

(54) GAS SWITCH TRIGGERED BY OPTICAL PULSE INTRODUCED BY OPTICAL FIBER

(71) Applicants: XI'AN JIAOTONG UNIVERSITY, Xi'an (CN); NORTHWEST INSTITUTE OF NUCLEAR TECHNOLOGY, Xi'an (CN)

(72) Inventors: Zhiguo Wang, Xi'an (CN); Fengju Sun, Xi'an (CN); Jiahui Yin, Xi'an (CN); Xiaofeng Jiang, Xi'an (CN); Aici Qiu, Xi'an (CN); Jian Wu, Xi'an (CN); Hongyu Jiang, Xi'an (CN); Xingwen Li, Xi'an (CN); Li Chen, Xi'an (CN); Penghui Li, Xi'an (CN)

(73) Assignees: XI'AN JIAOTONG UNIVERSITY, Xi'an (CN); NORTHWEST INSTITUTE OF NUCLEAR TECHNOLOGY, Xi'an (CN)

( * ) Notice: Subject to any disclaimer, the term of this patent is extended or adjusted under 35 U.S.C. 154(b) by 0 days.

(21) Appl. No.: 17/058,639

(22) PCT Filed: Mar. 18, 2019

(86) PCT No.: PCT/CN2019/078540
§ 371 (c)(1),
(2) Date: Nov. 24, 2020

(87) PCT Pub. No.: WO2019/223407
PCT Pub. Date: Nov. 28, 2019

(65) Prior Publication Data

US 2021/0210932 A1 Jul. 8, 2021

(30) Foreign Application Priority Data

May 24, 2018 (CN) ..... 201810510268.8

(51) Int. Cl.
*H01T 1/16* (2006.01)
*H01T 2/02* (2006.01)

(52) U.S. Cl.
CPC ..... *H01T 1/16* (2013.01); *H01T 2/02* (2013.01)

(58) Field of Classification Search
CPC ..... H01T 1/16; H01T 2/02
See application file for complete search history.

(56) References Cited

U.S. PATENT DOCUMENTS 7,692,913 B2 * 4/2010 Frescaline ..... H01T 2/02 361/130

FOREIGN PATENT DOCUMENTS

CN 104079279 A 10/2014
CN 106877176 A 6/2017
(Continued)

OTHER PUBLICATIONS

International Search Report (PCT/CN2019/078540); dated May 29, 2019.

*Primary Examiner* — Vip Patel
(74) *Attorney, Agent, or Firm* — W&G Law Group

(57) ABSTRACT

Provided is a gas switch triggered by an optical pulse introduced by an optical fiber, which solves the problem of the existing electrically-triggered gas switch and laser-triggered gas having a complicated trigger system, being insufficiently reliable and having a higher cost due to the pulse amplitude/laser beam energy having higher requirements. The gas switch triggered by an optical pulse introduced by an optical fiber includes at least one trigger gap and one self-breakdown gap; each trigger gap is connected in parallel to a photoconductive switch, and an optical fiber is correspondingly provided for introducing an optical pulse for triggering. In the present disclosure, the advantages of a low trigger requirement of a photoconductive switch and a high voltage and large conduction current of a gas switch are fully
(Continued)

utilized, and an optical pulse introduced by an optical fiber is used to trigger the photoconductive switch, so that the gas switch can be controlled and triggered under the action of a low-energy optical pulse (which can be less than 200 μJ) transmitted by optical fiber, thereby greatly simplifying the scale and complexity of the trigger system and promoting the development and application of the pulse power supply technology.

6 Claims, 2 Drawing Sheets

(56) References Cited

FOREIGN PATENT DOCUMENTS

| | | | |
|---|---|---|---|
| CN | 108390257 | A | 8/2018 |
| CN | 208241077 | U | 12/2018 |

* cited by examiner

GAS SWITCH TRIGGERED BY OPTICAL PULSE INTRODUCED BY OPTICAL FIBER

TECHNICAL FIELD

The present disclosure relates to a high-voltage gas spark switch.

BACKGROUND

A switch is one of the core devices of a pulse power device, and its performance directly affects output characteristics of the device. A gas switch is a switch device in which one or more gaps are formed between a plurality of electrodes, and gas filled in the one or more gaps are utilized to achieve high voltage on-off. The gap which is directly turned on under an action of an external trigger pulse is a trigger gap, and other gap is a self-breakdown gap. A gas switch has various advantages, such as a high working voltage, a large conduction current, fast trigger response, low trigger jitter and a low cost, and thus is widely used in the technical field of pulse power and high voltage electrical engineering.

At present, gas switches are usually triggered by high-amplitude electric pulses. Taking a ±100 kV multi-gap gas switch used in a Fast Linear Transformer Driver (FLTD) as an example (Jiang Xiaofeng, Sun Fengju, Liang TianXue, et al. Experimental Study on Breakdown Characteristics of a Multi-gap Gas Switch [J]. High Voltage Technology, 2009 (01):103-107), the gas switch is a 6-gap gas switch. In order to ensure that the switch trigger jitter is less than 5 ns, an amplitude of the trigger pulse is required to be greater than 140 kV. Due to a high requirement of a gas switch on the amplitude of an electric trigger pulse, the trigger system is complicated and huge, and introduction of a trigger cable is difficult, which has become a main limiting factor in application of the FLTD technology.

A high energy laser pulse can also be used to trigger a gas switch. Taking a 200 kV multi-gap switch triggered by laser as an example (Li Hongtao, Wang Yujuan, Xia Minghe, et al. Study on the Trigger delay and Jitter of Laser-triggered Multi-stage Switch [J]. High Voltage Technology, 2006 (02):48-50), the gas switch is formed by a 10 mm laser trigger gap and 9 stages of 1 mm overvoltage self-breakdown gaps, and is directly triggered by a laser beam. The required trigger laser energy is more than 15 mJ, and the laser wavelength is 266 nm. However, due to the extremely complex optical path when being triggered by a laser beam, and a high requirement on environment and a high cost of the optical path system, 200 kV gas switches are rarely directly triggered by high-energy laser beams at present.

The existing gas switches have high requirements on the amplitude of an electric trigger pulse and the energy of a laser trigger pulse, thereby limiting application of gas switches in pulse power devices.

SUMMARY

In order to solve the problems of the existing electrically-triggered gas switch and laser-triggered gas having a complicated trigger system, being insufficiently reliable and having a higher cost due to the pulse amplitude/laser beam energy having higher requirements, the present disclosure provides a gas switch triggered by an optical pulse introduced by an optical fiber.

A core idea of the present disclosure lies in that, a photoconductive switch is connected in parallel to a trigger gap of a gas switch, and the photoconductive switch is triggered by using a low-energy optical pulse introduced by the optical fiber, so that the trigger gap of the switch is turned on, thereby finally achieving that the gas switch is controlled to be turned on.

The technical solution of the present disclosure is as follows.

A gas switch triggered by an optical pulse introduced by an optical fiber, the gas switch including at least one trigger gap and at least one self-breakdown gap, it is characterized in that each of the at least one trigger gap is connected in parallel to a respective photoconductive switch, and the optical fiber is correspondingly provided to introduce the optical pulse for triggering.

Further, a respective current-limiting resistor is connected in series to the respective photoconductive switch, which is connected in parallel to each of the at least one trigger gap, so as to limit a current flowing thorough the photoconductive switch, thereby preventing the photoconductive switch from being damaged by overcurrent.

Further, each of the at least one trigger gap and the at least one self-breakdown gap is connected in parallel to a respective resistor having a same resistance value, and the respective resistor having a same resistance value is a voltage-sharing resistor. In this way, the voltage of each gas gap in evenly distributed.

The at least one trigger gap and the at least one self-breakdown gap are defined by switch electrodes that are all installed inside an insulating shell, and in order to install the above-mentioned components more concisely and conveniently, a respective hole corresponding to each intermediate electrode is formed at a position at a side of the insulating shell, and a respective high voltage lead-out pin is placed at the position; one end of the high voltage lead-out pin is in contact with the intermediate electrode, and the other end of the high voltage lead-out pin is located outside the insulating shell and is configured to be connected to the voltage-sharing resistor, the current-limiting resistor and the photoconductive switch.

Further, the voltage-sharing resistor and the current-limiting resistor are glass glaze resistors.

Further, the photoconductive switch is encapsulated by a solid transparent gel, and an output end surface of the optical fiber is closely attached to and fixed to an encapsulation end surface of the photoconductive switch.

The present disclosure has the following beneficial effects.

In the present disclosure, the photoconductive switch technology and the gas switch technology are combined, the advantages of low trigger requirements of a photoconductive switch and a high voltage and a large current of the gas switch are fully utilized, and the optical pulse introduced by an optical fiber is used to trigger the photoconductive switch, so that the gas switch can be controlled to be triggered under an action of a low-energy optical pulse (which can be less than 200 μJ) transmitted by the optical fiber, thereby greatly simplifying the scale and complexity of the trigger system and promoting the development and application of the pulse power supply technology.

A respective resistor of the resistors having a same resistance value is connected in parallel to each gap of the gas switch, so that the voltage of each gap of the switch in the DC withstand voltage process can be distributed more evenly, thereby effectively reducing a possibility of self-discharge of the switch.

In the figures, 1—high voltage electrode; 2—intermediate electrode; 3—current-limiting resistor; 4—photoconductive switch; 5—optical fiber; 6—voltage-sharing resistor; 7—insulating cover; 8—insulating shell; 9—gas nozzle; 10—high voltage lead-out pin; 11—electrode support; 12—high voltage electrode fixing part.

DESCRIPTION OF EMBODIMENTS

The present disclosure will be illustrated through specific embodiments with reference to the accompanying drawings.

Figure 1:
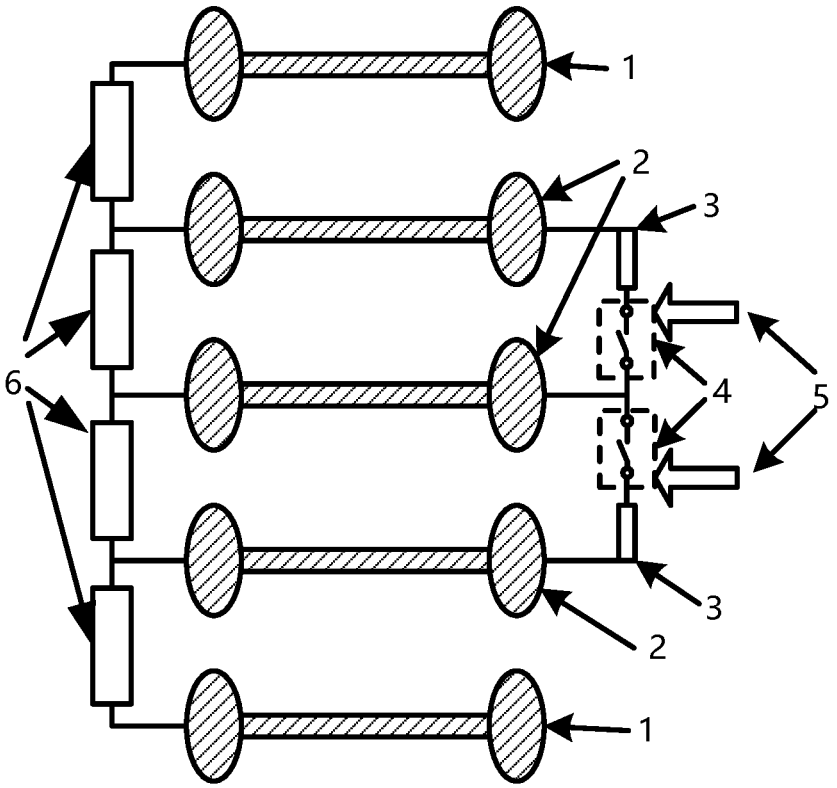
FIG. 1 is a schematic diagram of a light-triggered gas switch according to the present disclosure.
Figure 2:
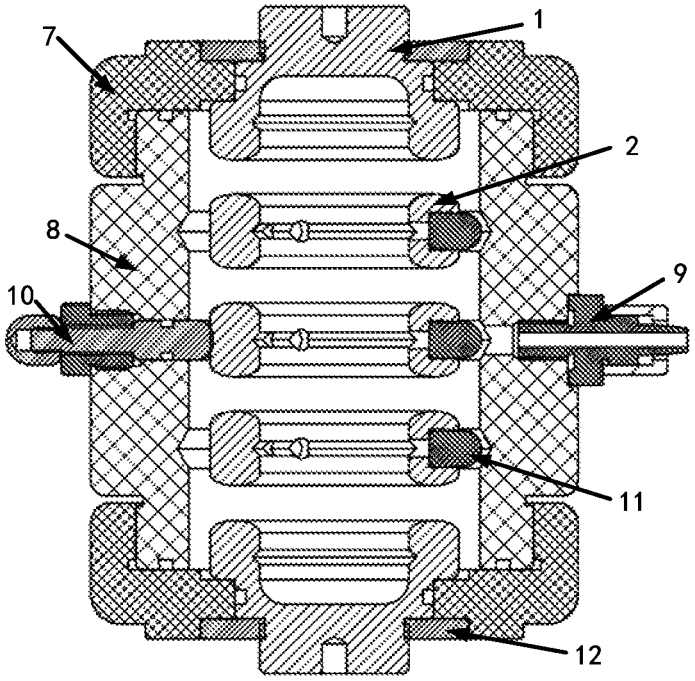
FIG. 2 is a longitudinal sectional view of an internal structure of a light-triggered gas switch according to the present disclosure.
Figure 3:
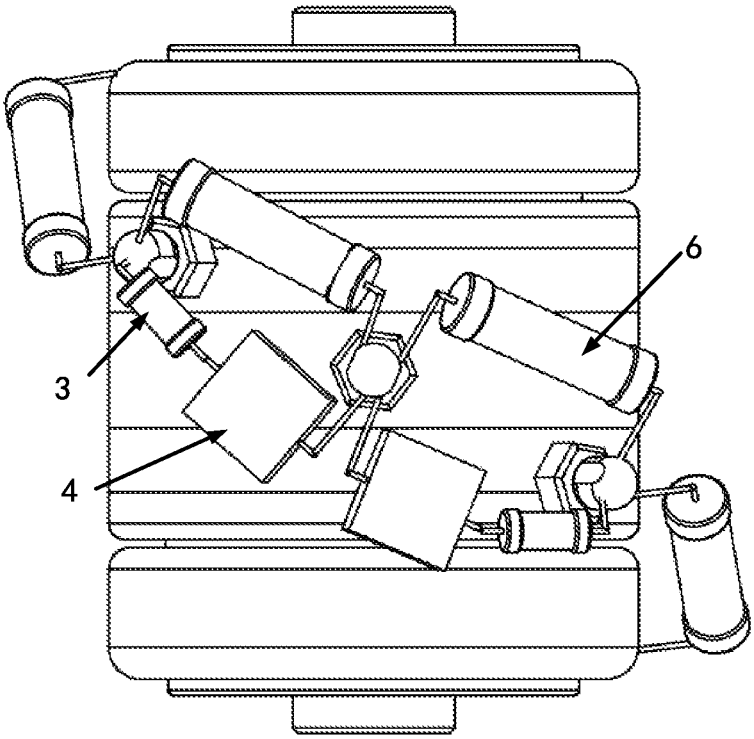
FIG. 3 is a schematic diagram of an outline of a light-triggered gas switch according to the present disclosure.

Taking a four-gap gas switch as an example, as shown in FIG. 1, the gas switch includes two high voltage electrodes, three intermediate electrodes, an insulating shell, a plurality of electrode supports, a high voltage lead-out pin, voltage-sharing resistors, current-limiting resistors and two photoconductive switches.

The high voltage electrodes and the intermediate electrodes are arranged along an axial direction to form four gas gaps in series, of which the outermost two gaps are self-breakdown gaps and the intermediate two gaps are trigger gaps. A hole corresponding to each intermediate electrode is formed at a position at a side of the insulating shell, and a high voltage lead-out pin is placed at the position. One end of the high voltage lead-out pin is in contact with the corresponding intermediate electrode, and the other end of the high voltage lead-out pin is located outside the insulating shell for conveniently connecting the voltage-sharing resistors, the current-limiting resistors and the photoconductive switches. The voltage-sharing resistors and the current-limiting resistors are made of glass glaze. A respective voltage-sharing resistor is connected in parallel to each gap of the switch, and all of the voltage-sharing resistors have a same resistance value. The photoconductive switch and the current-limiting resistor are connected in series and then connected in parallel to the trigger gap.

In the present disclosure, an installation process thereof is as follows: the intermediate electrodes 2 are installed in the insulating shell 8 and fixed by three electrode supports 11 in which the voltage is distributed evenly; then each of the high voltage electrodes 1 is installed into the insulating cover 7 and fixed by the high voltage electrode fixing part 12; and then two ends of the insulating shell 8 are respectively screwed into the insulating cover 7. Each of the high voltage electrode 1 and the insulating shell 8 is provided with a sealing ring. The high voltage electrode 1 is sealed with the insulating cover 7 radially, and the insulating shell 8 is sealed with the insulating cover 7 axially. A gas nozzle 9 is installed to the insulating shell 8, and a high voltage lead-out pin 10 is inserted into the hole formed at a side of the insulating shell 8 to ensure good contact with the intermediate electrode 2. A respective voltage-sharing resistor 6 is connected in parallel to each gap, and a respective photoconductive switch 4 and a respective current-limiting resistor 3 are connected in parallel to the trigger gap. The photoconductive switch 4 is encapsulated with a solid transparent gel, and an output end surface of the optical fiber 5 is closely attached to and fixed to an encapsulation end surface of the photoconductive switch 4.

The gas switch according to the present disclosure has a height of 135 mm, a diameter of 100 mm, a maximum working voltage of ±100 kV, and a working medium of SF6, N2, dry air or a mixture thereof. For the photoconductive switch, a static withstand voltage is greater than 50 kV, a conduction current is greater than 100 A, energy of the optical pulse for triggering is less than 200 μJ, and a wavelength is 1064 nm. Each of the voltage-sharing resistors has a resistance values of 300 MΩ. Each of the current-limiting resistors has a resistance value of 1 kΩ.

The voltage distribution in each gap of the switch during DC withstand voltage process is mainly affected by the voltage-sharing resistor. By in parallel connecting the respective voltage-sharing resistor of the voltage-sharing resistors having the same resistance value, the voltage is evenly distributed in each gap. In the triggering process, the photoconductive switch, which is connected in parallel to the trigger gap, is turned on under an action of the optical pulse transmitted by the optical fiber, so that the voltage of each gap is redistributed, one gap is over-voltage turned on, and the other gaps sequentially have over-voltage breakdown under an environment of electric-discharging ultraviolet light, thereby achieving that the switch is controlled to be turned on.

A specific working process is as follows: in static withstand voltage process, DC high voltages of ±100 kV are respectively applied to the high voltage electrodes of the switch, and the intermediate electrode is at a suspended potential, the voltage of each gap is evenly distributed, and the withstand voltage of each gap is 50 kV. Since an impedance of the photoconductive switch is much larger than the resistance value of the voltage-sharing resistor when not being turned on, an equivalent impedance of each gap of the switch is 300 MΩ. When the light-triggered pulse reaches the photoconductive switch, the impedance of the photoconductive switch rapidly decreases to several ohms. At this time, the equivalent impedance of the trigger gap is the impedance of the current-limiting resistor, i.e., 1 kΩ, which is far lower than that of the self-breakdown gap. The voltage of each gap is redistributed, and the withstand voltage of the self-breakdown gap changes from 50 kV to approximately 100 kV, resulting in overvoltage breakdown. After breakdown of the self-breakdown gap, the equivalent impedance decreases rapidly, and the withstand voltage of the switch is redistributed to the trigger gap, resulting in overvoltage breakdown of the trigger gap, and finally the switch is fully turned on.

What is claimed is:

1. A gas switch triggered by an optical pulse introduced by an optical fiber, the gas switch comprising at least one trigger gap and at least one self-breakdown gap, wherein each of the at least one trigger gap is connected in parallel to a respective photoconductive switch, and the optical fiber is correspondingly provided to introduce the optical pulse for triggering.

2. The gas switch triggered by an optical pulse introduced by an optical fiber according to claim 1, wherein a respective current-limiting resistor is connected in series to the respective photoconductive switch, which is connected in parallel to each of the at least one trigger gap.

3. The gas switch triggered by an optical pulse introduced by an optical fiber according to claim 2, wherein each of the at least one trigger gap and the at least one self-breakdown gap is connected in parallel to a respective resistor having a same resistance value, and the resistor having the same resistance value is a voltage-sharing resistor.

4. The gas switch triggered by an optical pulse introduced by an optical fiber according to claim 3, wherein the at least one trigger gap and the at least one self-breakdown gap are defined by switch electrodes that are all installed inside an insulating shell, and a respective hole corresponding to each intermediate electrode is formed at a position at a side of the insulating shell, and a respective high voltage lead-out pin is placed at the position; one end of the high voltage lead-out pin is in contact with the intermediate electrode, and the other end of the high voltage lead-out pin is located outside the insulating shell and is configured to be connected to the voltage-sharing resistor, the current-limiting resistor and the photoconductive switch.

5. The gas switch triggered by an optical pulse introduced by an optical fiber according to claim 3, wherein the voltage-sharing resistor and the current-limiting resistor are glass glaze resistors.

6. The gas switch triggered by an optical pulse introduced by an optical fiber according to claim 4, wherein the photoconductive switch is encapsulated by a solid transparent gel, and an output end surface of the optical fiber is closely attached to and fixed to an encapsulation end surface of the photoconductive switch.

* * * * *